US006401730B1

(12) United States Patent
Knapp

(10) Patent No.: US 6,401,730 B1
(45) Date of Patent: Jun. 11, 2002

(54) CONTAINER WASH SYSTEM

(76) Inventor: Julius Z. Knapp, 22 Foxwood Dr., Somerset, NJ (US) 08873-1707

( * ) Notice: Subject to any disclaimer, the term of this patent is extended or adjusted under 35 U.S.C. 154(b) by 0 days.

(21) Appl. No.: 09/764,806

(22) Filed: Jan. 17, 2001

(51) Int. Cl.[7] ..... B08B 3/02; B08B 3/04; B08B 9/00; B08B 9/027; B08B 9/093

(52) U.S. Cl. ..... 134/22.18; 134/22.11; 134/22.12; 134/22.15; 134/34; 134/36; 134/37

(58) Field of Search ..... 134/22.11, 22.12, 134/22.15, 22.18, 34, 36, 37, 42

(56) References Cited

U.S. PATENT DOCUMENTS 3,531,299 A * 9/1970 Benjamins ..... 134/22.1
3,922,750 A * 12/1975 Cioni et al. ..... 15/302
4,080,974 A * 3/1978 Oag ..... 134/62
5,135,014 A * 8/1992 Beswick ..... 134/60
5,419,348 A * 5/1995 Kuta ..... 134/58 R
5,441,063 A * 8/1995 Fernandez et al. ..... 134/142

* cited by examiner

*Primary Examiner*—Zeinab El-Arini

(57) ABSTRACT

A method for cleaning small volume pharmaceutical containers of particulate contamination, which includes the simultaneous introduction of air and cleaning fluid as a moving film on the interior of the container, particulary in a neck region, to prevent re-deposit of contaminant particulates thereon. A nozzle is used for introduction of fluid such as water into the container and a tube within or otherwise juxtaposed with the nozzle is used for the simultaneous introduction of air. Cleaning is effected before initial medical application use.

4 Claims, 1 Drawing Sheet

CONTAINER WASH SYSTEM

FIELD OF THE INVENTION

This invention relates to methods for the cleaning of small containers for medical applications, particularly those with small orifices and with abrupt orifice shoulder areas, to the cleanliness standards necessary for pharmaceutical use with injectable preparations.

BACKGROUND OF THE INVENTION

Before a container, such as a glass vial, can be used for an injectable pharmaceutical product it must be scrupulously cleaned. The cleaning process is used to free it from particulate contaminants that could, when injected, result in circulatory system obstruction. These particulate contaminants can be introduced into the container during formation, shipment and storage prior to use. Containers in general, used for small volume injectable preparations, e.g., those in the volume range from 1 to 100 milliliters, have a special disability. The small diameter container orifice, combined with small container volume, has been recognized as a limitation on the cleanliness that can be achieved. Balancing health risk versus benefit of the many important small volume injectable drugs, a special, higher contamination allowance in particle contamination standards has been set by the United States Pharmacopeia, (USP 24 official from Jan. 1, 2000) for small volume injectable products.

Particle contamination standards are defined separately for the small volume injectable range (those containers 1–100 ml) in capacity from those in the large volume injectable range (containers greater than 100 ml ranging up to 1 liter in capacity). The contamination standard limits are expressed in two size ranges, determined by the perceived effect on the patient. A major contaminant comprises substantially inert particles of detectably large relative size in an objectionably large number. Two quality limit standards have been, for example, set for the number of particles greater than 10 $\mu$m and for the number of particles greater than 25 $\mu$m depending on container size:

| | ≧10 $\mu$m | ≧25 $\mu$m | |
|---|---|---|---|
| Small-volume | 6,000/container | 600/container | injections |
| Large-volume | 25 per ml | 3 per ml | injections |

The effect of container size graded contamination standards is thus most disproportionate for small containers. For instance, a 2 ml container, applying large-volume contamination limits, results in a maximum acceptable count of contaminating particles greater than 10 $\mu$m to be 50 particles and the limit for particles greater than 25 $\mu$m to be 6 particles. However the acceptable limit, using the small container handicap, is 6000 particles greater for ≧10 $\mu$m and 600 greater for ≧25 $\mu$m. The disproportionate quality standards are the result of a defect in the present art employed in the washing of these small containers according to the following procedure:

The small containers, with neck orifices of 13 to 22 mm, are usually jet washed in an inverted position with washing fluid swirling into and out of the inverted container. This procedure results in some contamination re-attachment under most standard washing conditions. Under such conditions, the end-of-wash drain velocity and time become critical factors in the random occurrence of drainage pools in the neck of the container and the consequent re-attachment of contaminating particles in the neck of the container immediately before the orifice. Larger volume containers however maintain a greater exit flow velocity for sufficient time to effectively minimize the re-deposition effect. Such exit velocity is however physically not possible with the smaller containers.

Accordingly in the smaller containers, the re-attached contaminating particles that remain in the container neck area are re-suspended in the liquid contents of the container as a result of handling and transport. Since these contaminating particles in injectable preparations are hazardous to patient health, containers with re-suspended particles are rejected either during the quality assurance inspection or at the medical use point. Rejects at quality assurance inspection add cost to the product. Rejects at the medical use point are damaging to the market image of the producer. A remedy that has been attempted in present art is the use of alternating the single or multiple wash jet positions with single or multiple filtered air or clean steam jets positions. This procedure results in delays of hundreds of milliseconds between the end of the wash jet and the following air or steam jet. This delay period results in the observed random pooling of the exiting wash fluid and the consequent re-attachment of the washed-down contaminating particles, the very condition being sought to be ameliorated.

SUMMARY OF THE INVENTION

It is accordingly an object of the present invention to provide an economical method and device for washing small containers, particularly those with the small orifice range and orifice shoulder design in present use, to prevent pooling and re-deposit of contaminants during washing.

Generally the present invention comprises a method and device for the cleaning of containers, and more specifically small volume containers up to about 100 ml, having a reduced orifice dimension and abruptly designed orifice shoulder regions, i.e., of smaller diameter than the remainder of said container, to prevent redeposit of initially dislodged contaminants thereon. The method of the present invention comprises the step of inverting the container and maintaining a film flow in the wash liquid effluent through the neck and shoulder area. The film flow serves to prevent the re-attachment of contaminating particles dislodged in the washing process. In a preferred embodiment of the present invention elimination of the re-attachment with formation of a flowing film is achieved by the simultaneous use of a cleaning fluid such as water and streams of an inert gas such as air or steam during the washing process. The combination of water and air under a pressure between about 5–30 psi provides a constant film flow as required. A device made in accordance with the present invention comprises inlet means for introduction of combined cleaning fluids such as water and air or clean steam being introduced into a container for the cleaning thereof.

The use of film flow for the effluent wash liquid ensures that particles detached in the wash procedure are maintained within a moving stream of wash fluid until exit from the container. For symmetrical containers with shoulders contoured in the flow direction, equal air and water volumes are adequate. For containers with squared shoulders, and other sharp internal discontinuities, air/water ratios and the delivery pressure employed are determined accordingly to maintain the flowing film in the discontinuities. In any event, pooling of exit water in the shoulder during the drainage must be avoided.

The above and other objects, features and advantages of the present invention will become more evident from the following discussion and drawings in which:

DETAILED DESCRIPTION OF THE INVENTION

In order to illustrate the effect of contamination re-deposit a comparison of the effect of the prior art washing method was carried in 10 ml beakers (no shoulder and 10 ml small volume containers). The beakers and containers were identically contaminated and washed with identical procedure. Both were washed and rinsed in an inverted position. The containers were capped with jet washed stoppers and then agitated to simulate random movement and handling. This experimental procedure resulted in no visible particles detected per beaker and a maximum of two 5 $\mu$m particles in destructive particle counter testing. The visible contamination levels were beyond USP acceptance levels in 98% of a test group of 300 5 ml containers.

Pressure levels of the air and water, used in the present invention, preferably each range between 5 and 30 psi and most preferably are about 25 psi.

Many configurations are possible to effect the simultaneous air and water dispensing such as an air conduit located within a water conduit with a common co-extensive opening.

Alternative configurations include two parallel tubes or tube groupings such as 1 central for air and a surround of 3 to 6 tubes of water to control spray patterns.

DETAILED DESCRIPTION OF THE DRAWINGS AND THE PREFERRED EMBODIMENT

Figure 1:
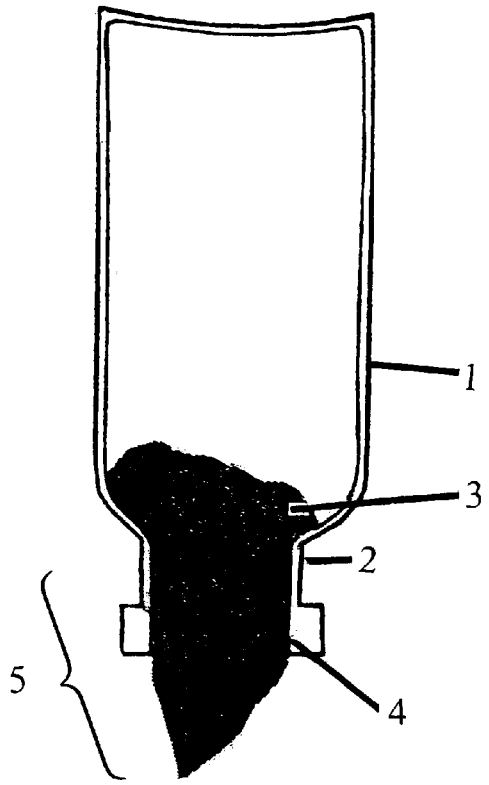
FIG. 1 depicts a small shouldered inverted container with indication of pooling of contaminants during normal washing.
Figure 2:
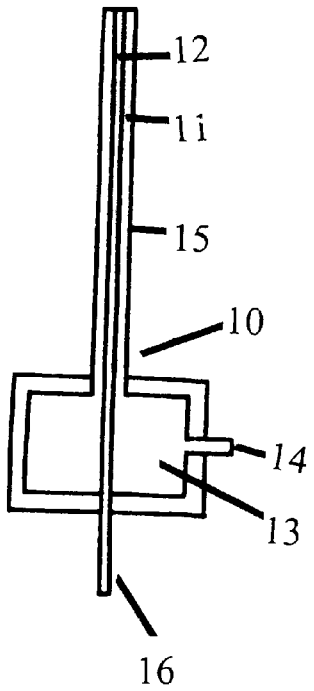
FIG. 2 depicts the same container being washed in accordance with the method of the present invention to maintain a constant flowing film on the interior surface thereof.

FIG. 1 illustrates the pooling of water in the neck area 2 of a small volume injectable container 1 during the drain portion of a prior art wash cycle. Area 3, the pooling area contains the re-deposited contaminants after the rinse cycle FIG. 2 is a cross-sectional view of a washing nozzle 10 of the present invention with concurrent water 11 and air 12 flow. Water is introduced into chamber 13 through inlet aperture 14 and into wash nozzle 15. Air is introduced through tube 16 positioned within wash nozzle 15, whereby both air and water are simultaneously jetted into the container as shown in FIG. 1. The simultaneous and continuous introduction of water and air forms a moving fluid film on the interior of the container and particularly on the pooling site areas 3 shown in FIG. 1. Re-deposit of particles is thereby prevented.

Equal 25 psi water and air delivery has been found to successfully clean 2 and 5 ml pharmaceutical glass containers with substantially no re-deposit of contaminants. In operation the washing nozzle is inserted within 3 to 5 mm from the inverted inside bottom 4 of the container in a period of approximately 200 milliseconds prior to the commencement of air and water flow. The nozzle is withdrawn at a rate of 5 to 25 cm/second. Water and air flow are maintained until the external finish area 5 of the container has been cleansed.

The use of controlled film flow of the effluent wash liquid provides the following advantages over current art:

a) The number of wash cycles and the amount of water used are reduced.

b) Washing machine complexity is reduced.

c) The cleanliness of the small volume injectable containers are as good or better than can be achieved in large volume containers for injectable pharmaceutical products.

It is understood that the above description and example are illustrative of the present invention and that changes may be made without departing from the scope of the present invention as defined in the following claims.

What is claimed is:

1. A method for the substantially complete removal of particulates from a container for subsequent use of the container in containing liquids for use in a medical application, said container having a neck region of reduced diameter adjacent an open aperture, said method comprising the steps of:

a. inverting the container whereby said open aperture faces downward;

b. introducing a pressurized fluid into said container through said aperture to wash and remove particulates from the interior of said container; and c. forming and maintaining said fluid in a moving film on the interior surface of the container whereby re-deposit of particulates from the interior surface of the container, adjacent said aperture, is substancially prevented, wherein sad fluid is formed and maintained as said moving film by serparately but simultaneously directing an inert pressurized gas with said fluid into said container, with the pressure of the fluid and the pressure of the gas being sufficient to form said moving film, and with said moving film being maintained at least until substantial removal of the particulates from the container.

2. The method of claim 1 wherein said container has a volume of less than 100 ml and wherein said container comprises an orifice shoulder area.

3. The method of claim 2, wherein said fluid is water and said gas is air or steam with said water and gas being pressurized in a pressure range from 5 to 30 psi.

4. The method of claim 1 wherein said particulates are removed from the container after formation of that container and before initial use of the container for the medical application.

* * * * *